US009700473B2

(12) United States Patent
Rogge

(10) Patent No.: US 9,700,473 B2
(45) Date of Patent: Jul. 11, 2017

(54) LIGHTWEIGHT FOLDABLE LIFT

(71) Applicant: Todd Rogge, Blair, NE (US)

(72) Inventor: Todd Rogge, Blair, NE (US)

( * ) Notice: Subject to any disclaimer, the term of this patent is extended or adjusted under 35 U.S.C. 154(b) by 0 days.

(21) Appl. No.: 14/873,575

(22) Filed: Oct. 2, 2015

(65) Prior Publication Data

US 2016/0228313 A1 Aug. 11, 2016

Related U.S. Application Data

(60) Provisional application No. 62/059,589, filed on Oct. 3, 2014.

(51) Int. Cl.
*A61G 7/10* (2006.01)

(52) U.S. Cl.
CPC ..... *A61G 7/1017* (2013.01); *A61G 7/1074* (2013.01); *A61G 7/1076* (2013.01)

(58) Field of Classification Search
CPC ..... A61G 7/10; A61G 7/1017
USPC ..... 5/81.1 R, 87.1, 89.1
See application file for complete search history.

(56) References Cited

U.S. PATENT DOCUMENTS 3,104,399 A * 9/1963 Dalton ..... A61G 7/1003 254/4 C
3,521,860 A 7/1970 Zehrung
4,334,668 A 6/1982 Caris
4,644,595 A 2/1987 Daniel
D349,996 S 8/1994 Litwiller
D374,208 S 10/1996 Eva
6,170,802 B1 1/2001 Stovall
6,612,548 B2 9/2003 Landreth
6,705,821 B2 3/2004 Philipps
6,994,618 B1 2/2006 Syers
7,506,388 B1 3/2009 Brown
7,625,269 B2 12/2009 Godwin
D644,811 S 9/2011 Clark
2005/0006631 A1* 1/2005 Ming-Hwa ..... A61G 7/1003 254/8 R
2005/0097670 A1* 5/2005 Hawk ..... A61G 7/05 5/84.1
2010/0107329 A1 5/2010 Nelson
2010/0132114 A1 6/2010 Becker
2012/0095777 A1 4/2012 Chang
2012/0297536 A1 11/2012 Koors

* cited by examiner

*Primary Examiner* — Fredrick Conley
(74) *Attorney, Agent, or Firm* — Milligan PC LLO

(57) ABSTRACT

The lift of the present invention includes a lightweight, foldable lift that can be conveniently transported and stored in a home or car. According to a first preferred embodiment, the lift of the present invention may be operated as a caregiver lift to allow a typical caregiver to handle a patient under a wider variety of conditions and circumstances than the industrial sized lifts of the prior art. Further, the lift of the present invention is designed to allow a patient to be moved in all directions and to operate on a variety of surfaces.

9 Claims, 7 Drawing Sheets

LIGHTWEIGHT FOLDABLE LIFT

RELATED APPLICATIONS

The present invention claims priority to U.S. Provisional Application No. 62/059,589 filed Oct. 3, 2014.

FIELD OF INVENTION

The present invention relates generally to a lifting mechanism and, in particular, to a light weight foldable lifting mechanism designed to aid an operator in lifting a load under a wide variety of settings and circumstances.

BACKGROUND OF THE INVENTION

Generally, a patient lift (also variously referred to as a patient hoist, jack hoist or hydraulic lift) may be either a sling lift or a sit-to-stand lift. These devices generally allow caregivers in hospitals and nursing homes to transfer patients between various sitting and standing positions using hydraulic power.

Sling lifts are used for patients whose mobility is very limited. These are variously designed as mobile lifts or overhead lifts (suspended from ceiling-mounted or overhead tracks). Sit-to-stand lifts are designed to help patients who have some mobility but who lack the strength or muscle control to rise to a standing position. These lifts use a system of straps, vests, or belts (as opposed to slings) to make the transition possible.

Most current lift units are designed to be able to pick up a patient in a sling and then move them from one hospital room to another using the wheels on the bottom of the legs. These lifts are effective in a hospital or nursing home setting, but their large size and weight along with their use of wheels for rotation and motion make them fairly ineffective in a home setting with tight walkways and carpet. The inability to mobilize patients at home is one of the primary reasons that patients find it necessary to leave the home environment and enter a nursing home when they become temporarily or permanently disabled.

SUMMARY OF THE INVENTION

The lift of the present invention includes a lightweight, foldable lift that can be conveniently transported and stored in a home or car. According to a first preferred embodiment, the lift of the present invention may be operated as a caregiver lift to allow a typical caregiver to handle a patient under a wider variety of conditions and circumstances than the industrial sized lifts of the prior art. Further, the lift of the present invention is designed to allow a patient to be moved in all directions and to operate on a variety of surfaces.

BRIEF DESCRIPTION OF THE DRAWINGS

The features and advantages of the present invention will be more clearly understood from the following description taken in conjunction with the accompanying drawings.

Like reference numerals refer to like parts throughout the description of several views of the drawings.

DETAILED DESCRIPTION OF THE INVENTION

Figure 1:
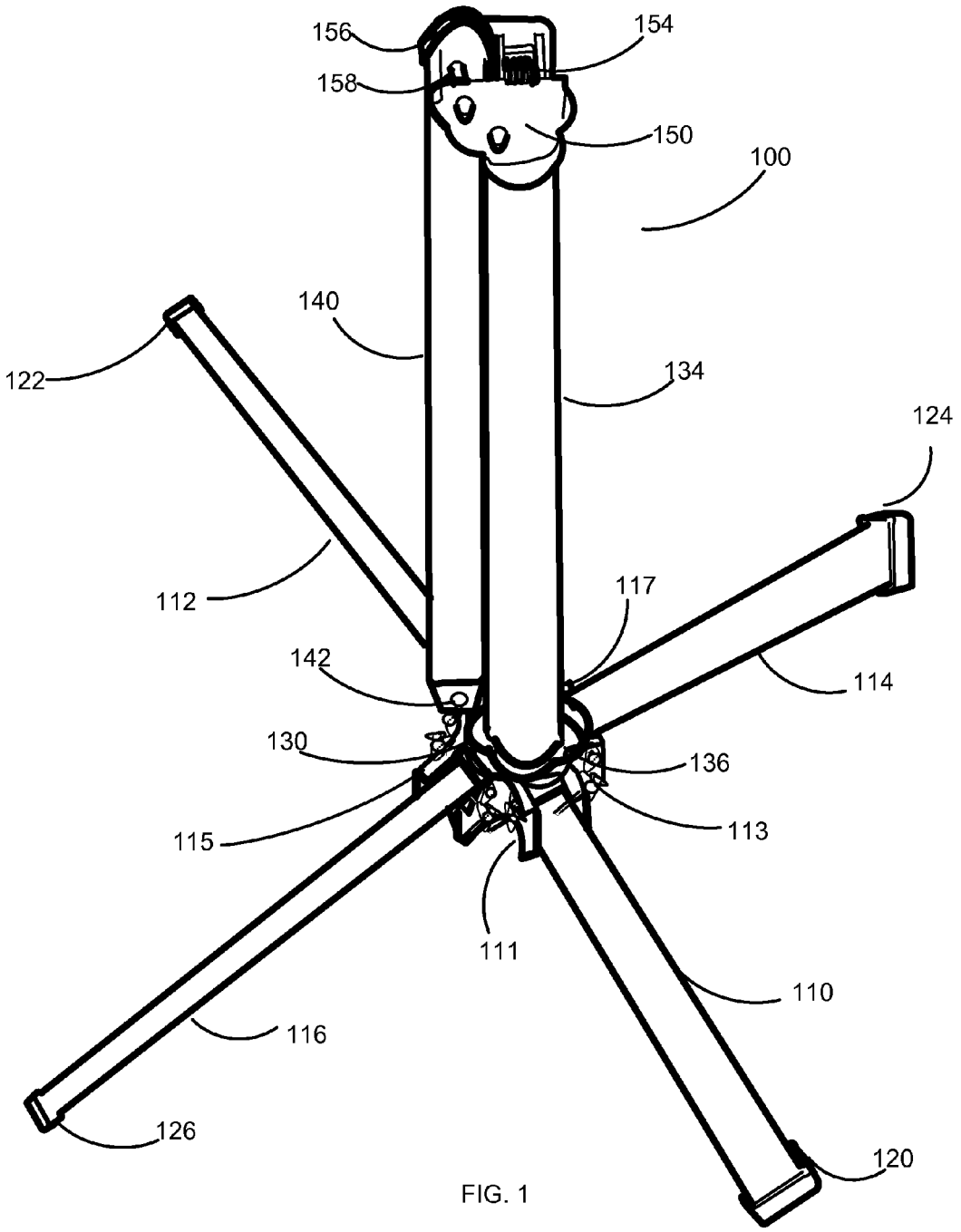
FIG. 1 shows a basic design of the caregiver lift of the present invention.

For the purposes of promoting an understanding of the principles of the present invention, reference will now be made to the embodiments illustrated in the drawings and specific language will be used to describe the same. It will nevertheless be understood that no limitation of the scope of the present invention is hereby intended and such alterations and further modifications in the illustrated devices are contemplated as would normally occur to one skilled in the art. For instance, in many embodiments the present invention is discussed and referred to as a patient lift. However, it should be understood that the present invention may be used as a general lifting mechanism which can lift any of a variety items and/or people in a variety of circumstances.

With reference now to FIG. 1, a first preferred embodiment of the present invention will now be discussed. As shown in FIG. 1, the major components of the caregiver lift of the present invention 100 preferably include a base housing 130 and a lifting mechanism 150. As shown, the base housing 130 preferably supports a center post 134 and provides four pivoting mounts 111, 113, 115 and 117 for connecting four legs 110, 112, 114 and 116. Preferably, the four legs 110, 112, 114 and 116 are composed of carbon fiber rectangular tubes that are pinned to the base housing. According to further preferred embodiment, feet or caps 120, 122, 124, 126 may be attached at the distal ends of each leg. According to a preferred embodiment, the feet and/or caps 120, 122, 124, 126 may be made of aluminum or other light weight metal. According to alternative embodiments, the feet and/or caps may alternatively be formed from or covered with non-slip material.

As further shown in FIG. 1, the lifting mechanism 150 preferably includes a motor or gear arrangement for applying a lifting force to the arm 140. According to a preferred embodiment, the lifting mechanism 150 of the present invention preferably includes a reducing worm gear set 154 which rotates a shaft and spools a carbon fiber ribbon 156. This carbon fiber ribbon 156 wraps around an arm pivot 158 which effectuates raising the arm 140 when the crank or lever is turned. The arm 140 is preferably composed of a carbon fiber rectangular tube which is preferably designed to pivot on an aluminum or steel plug. At the distal end of the arm 140, a plug 142 is preferably provided to attach to a harness clip or other connection mechanism.

Figure 2:
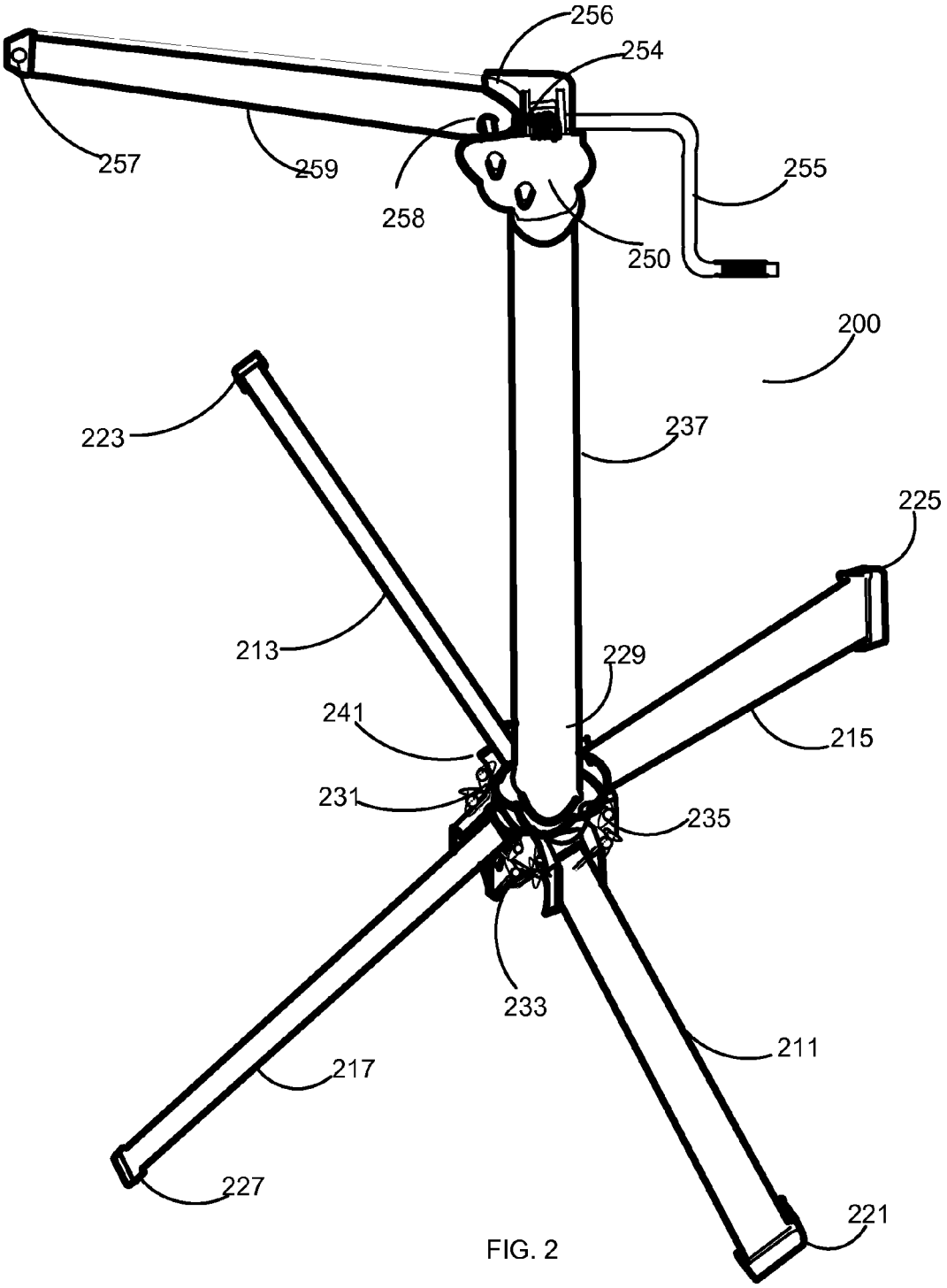
FIG. 2 shows a basic design of the caregiver lift of the present invention in an extended position.

With reference now to FIG. 2, the operation and design of a preferred embodiment of the present invention will now be further discussed. As shown in FIG. 2, the major components of the caregiver lift of the present invention 200 preferably include a base housing 241, a lifting mechanism 250, an arm 259 (shown in an extended position) and a crank 255 which may be removable or permanently attached. As shown, the base housing 241 supports a center post 237 and provides four pivoting mounts 229, 231, 233 and 235 for connecting four legs 211, 213, 215 and 217. Preferably, the four legs 211, 213, 215 and 217 are composed of four carbon fiber rectangular tubes that are pinned to the base housing 241. Further, feet or caps 221, 223, 225, 227 may preferably be attached at the distal ends of each leg.

As further shown in FIG. 2 and as discussed above, the lifting mechanism 250 preferably includes a reducing worm gear set 254 which rotates a shaft and spools a carbon fiber ribbon 256. In operation, this carbon fiber ribbon 256 preferably wraps around an arm pivot 258 which effectuates raising the arm 259 when the crank or lever 255 is turned. The arm 259 is preferably composed of a carbon fiber rectangular tube which is preferably designed to pivot on an aluminum or steel plug. At the distal end of the arm 259, a plug 257 is preferably provided to attach to a harness clip or other connection mechanism.

Preferably, the manual crank or lever 255 may be geared such that it can be turned easily. According to preferred embodiment, the lifting mechanism 250 preferably includes a locking mechanism so that the arm is kept stationary while the patient is suspended and the crank 255 is unattended. While in an unlocked position, the arm 259 may preferably rotate 360 degrees while supporting a harness. Preferably, the crank 255 will hold its own position with or without a lock and regardless of the arm position of the lifting mechanism 250. As discussed in more detail below, the lifting mechanism 250 may alternatively include a hydraulic lifting mechanism in place of the manual crank. Still further, the locking mechanism may be a hydraulic locking mechanism or a locking switch within the hydraulic lifting mechanism to keep the arm stationary.

Figure 3:
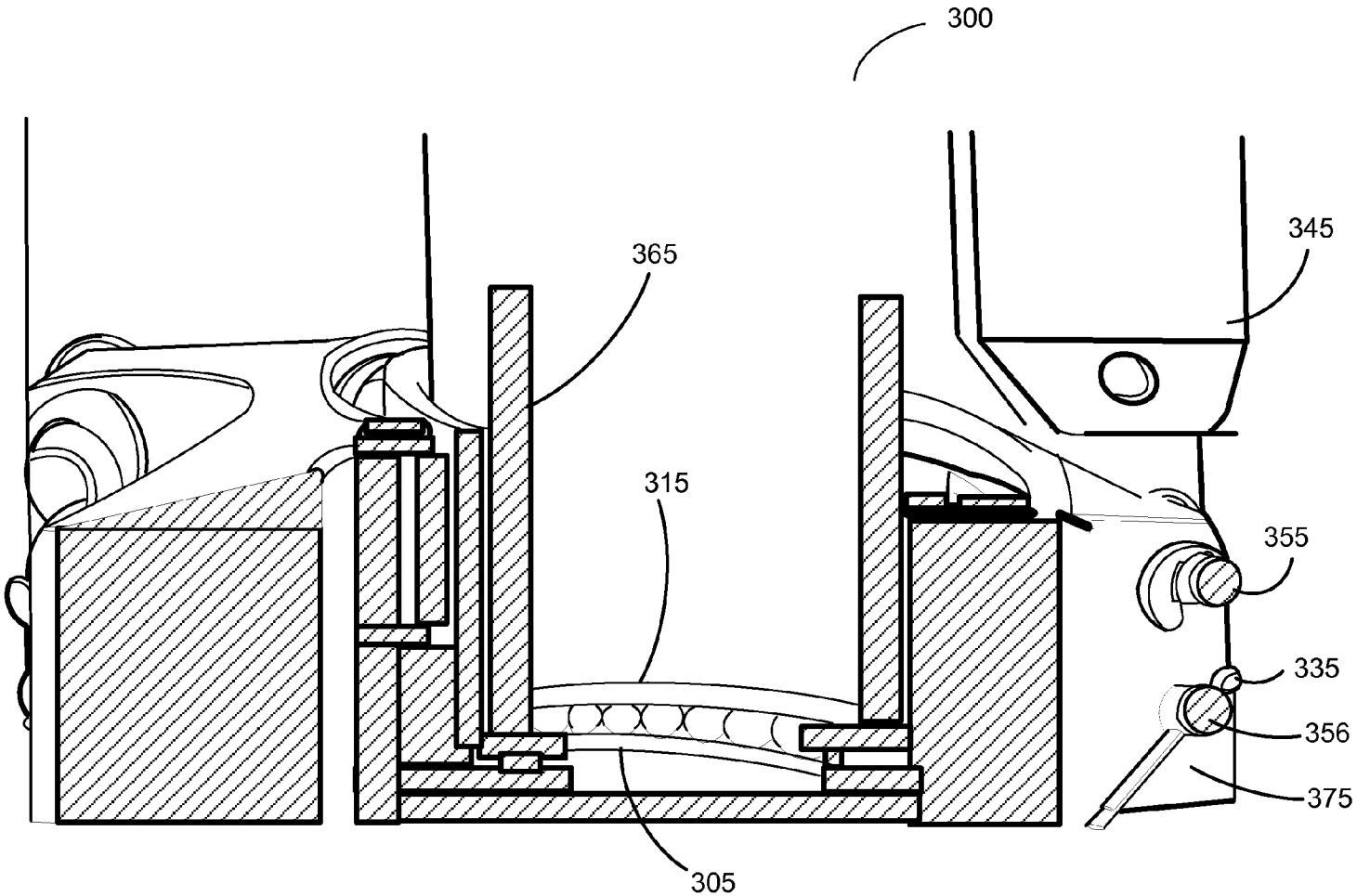
FIG. 3 shows the base housing of the caregiver lift of the present invention.

With reference now to FIG. 3, a preferred embodiment of the base housing 300 of the caregiver lift of the present invention will now be discussed. As shown in FIG. 3, the base housing 300 preferably contains at least two bearings 305 and 315 to constrain motion of the center post 365 to purely rotation. In operation, the base 300 also preferably serves as a pivoting mount 375 for each leg. As shown, each leg 245 is preferably connected to the base 300 via a bolt(s) 355, 356 or the like. Preferably, some variety of quick disconnect pin 335 may be used for securing the bolt(s) 355, 356 in place.

Due to the extreme forces exerted under normal operation, it is preferred that the pins and bolts of the present invention be made of high strength steel (>200 ksi) or similar material to keep from shearing when loaded. Additionally, because the base housing 300 of the present invention is subject to large amounts of stress, it is further preferred that it is made of high strength aluminum (>70 ksi yield) or a high quality grade of stainless steel.

Figure 4:
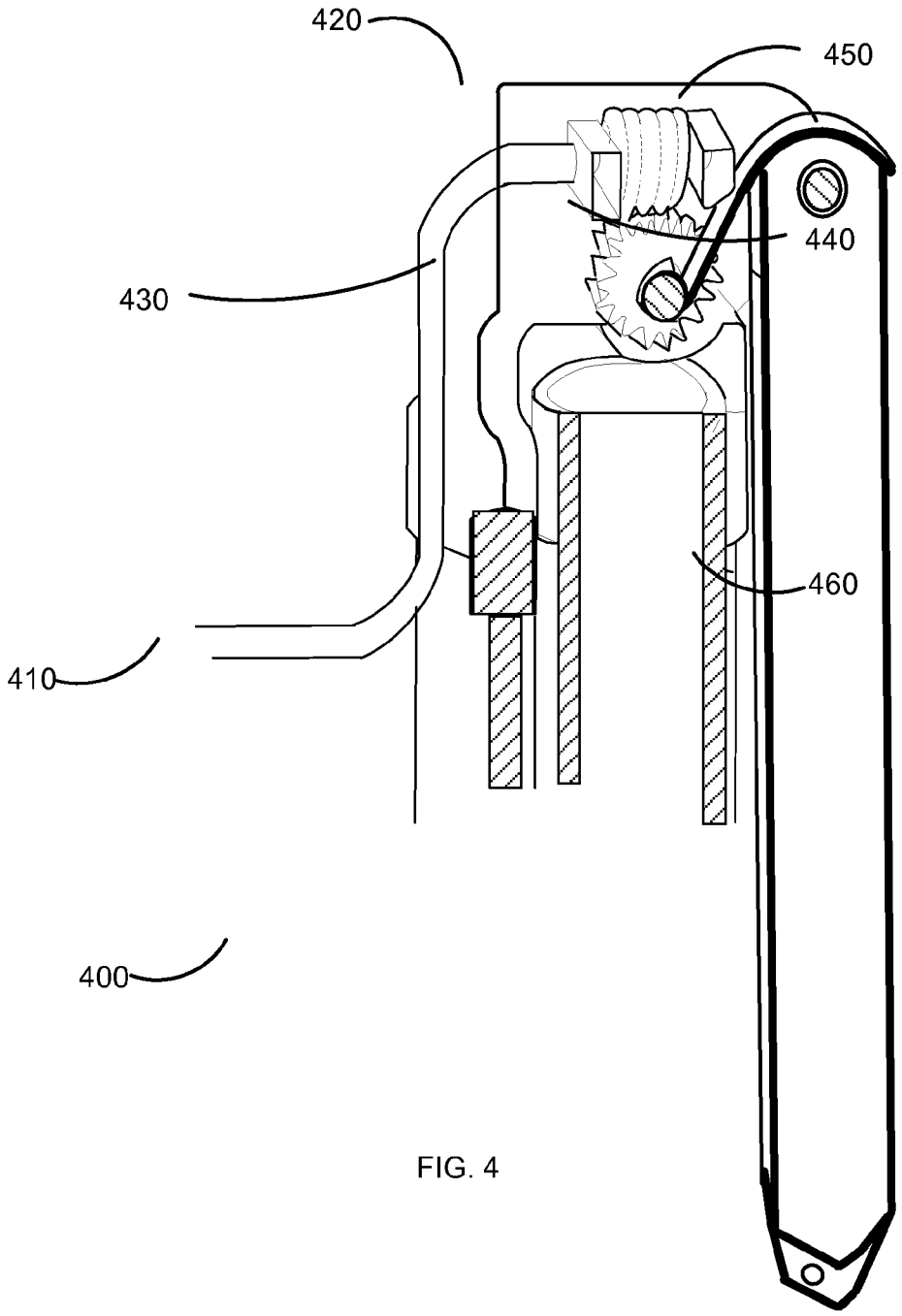
FIG. 4 shows a preferred embodiment of the lifting mechanism of the present invention.
Figure 7:
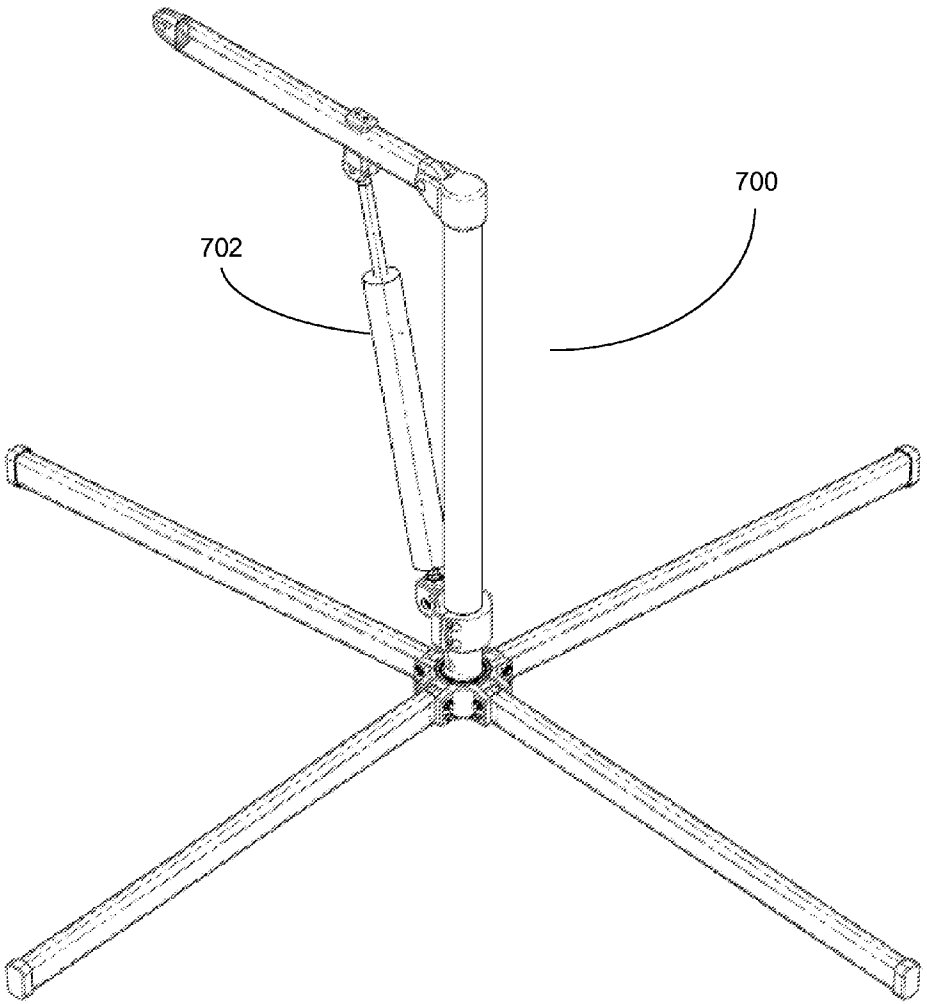
FIG. 7 shows an alternative embodiment of the lifting mechanism of the present invention.

With reference now to FIG. 4, a preferred embodiment of the lifting mechanism 400 of the present invention will now be discussed. As shown in FIG. 4, the lifting mechanism 400 may use a removable hand crank 410 which when engaged applies torque to a reducing worm gear set 420. Preferably, the worm gear 420 is positioned to rotate a shaft 430 which in turn spools a carbon fiber ribbon 440. As shown, the carbon fiber ribbon 440 is preferably wrapped around the arm pivot 450 so that, when the carbon fiber ribbon 440 is spooled, the arm 460 is raised. According to an alternative embodiment, the arm 460 may be actuated via a hydraulic pump, lead screw, electric drive or other force producing mechanism. For example, as shown in FIG. 7, an alternative embodiment of the present invention may include a lift mechanism 700 which includes an adjustable hydraulic pump 702 to lift and maneuver a patient in place of the hand crank 410 discussed above.

Figure 5:
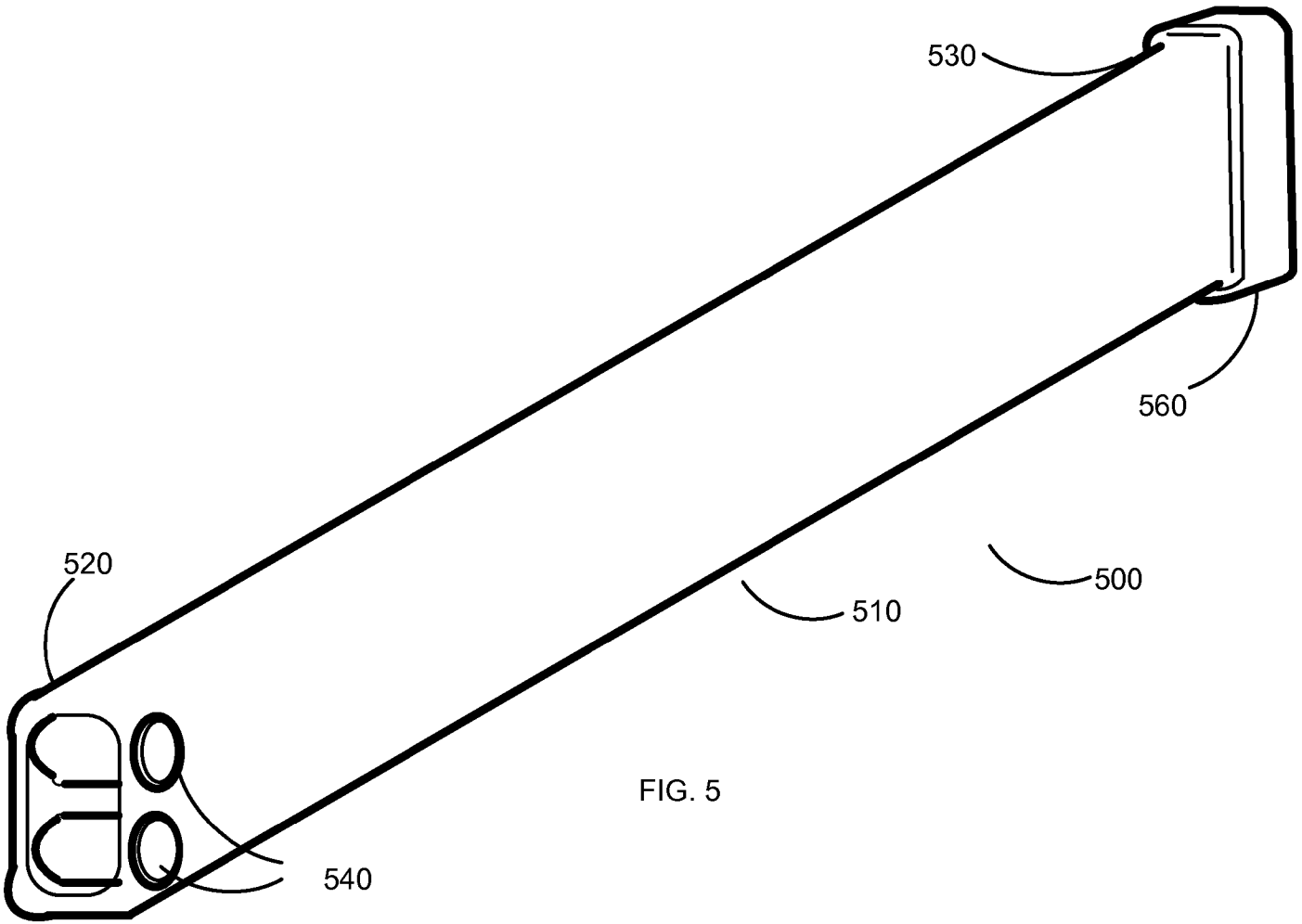
FIG. 5 shows a preferred embodiment of the legs of the present invention.

[0032]. With reference now to FIG. 5, a preferred embodiment of the legs of the present invention will now be discussed. As shown in FIG. 5, an exemplary view of one of the four identical legs 500 of the present invention is provided. According to one preferred embodiment of the present invention, the dimensions of each carbon fiber rectangular tube 510 may be approximately 96.520 cm×2.54 cm×5.0800 cm (38 inches×1 inch×2 inches) with a preferred material thickness of approximately 0.50800 cm (0.2 inch) thickness. According to an alternative preferred embodiment, the dimensions of the rectangular tube 605 may be approximately 28 inches×1 inch×2 inches. At the proximal end 520 of a leg unit 500, two brass bearings 540 may be provided for allowing connection to a pivoting mount 375 of the lift base 300 (as shown in FIG. 3). Preferably, the distal end 530 of a leg unit 500 is covered with feet or caps 560 at the end.

Figure 6:
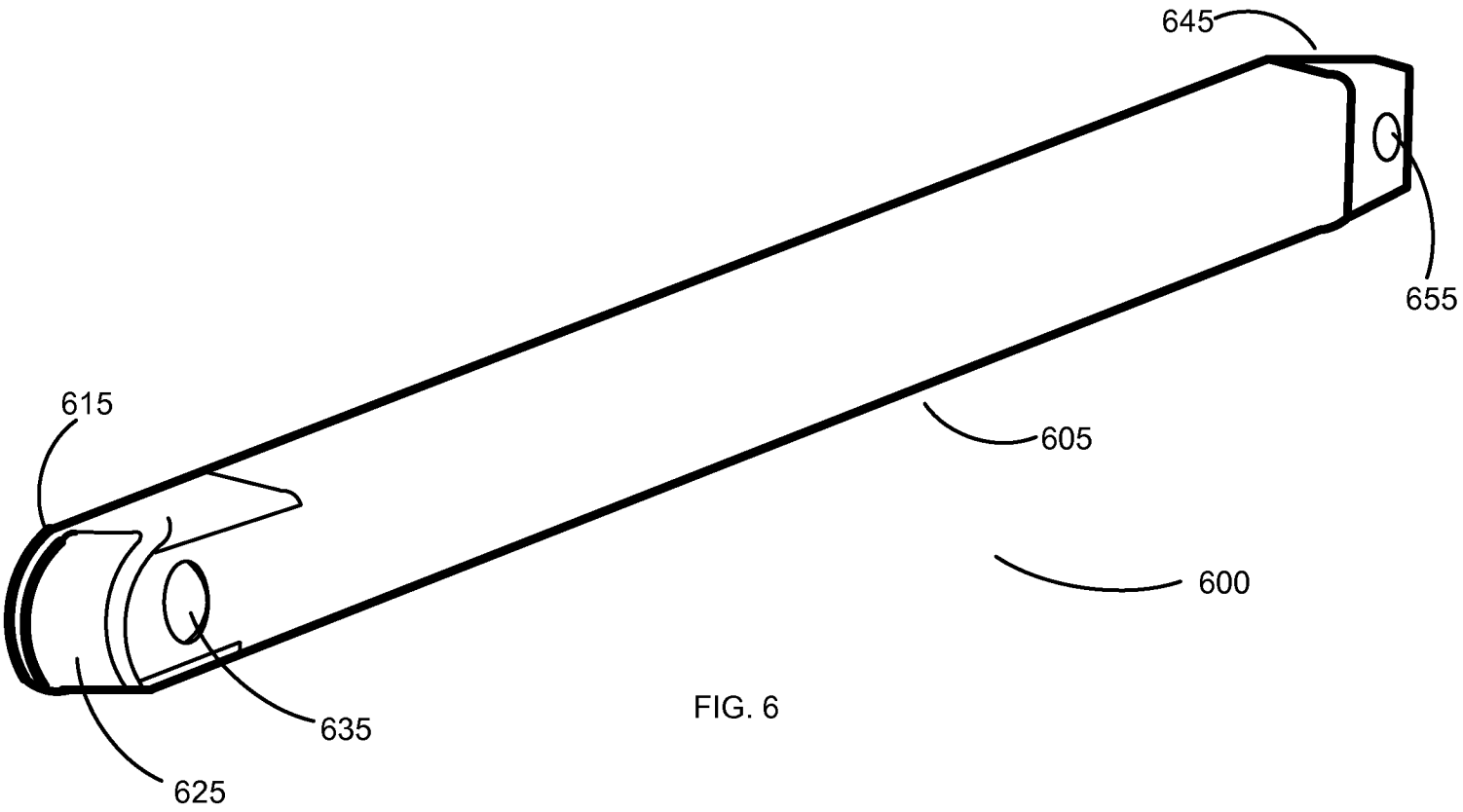
FIG. 6 shows a preferred embodiment of the arm of the present invention.

With reference now to FIG. 6, a preferred embodiment of the arm of the present invention will now be discussed. As shown in FIG. 6, a single arm 600 is shown. Preferably, the arm 600 of the present invention consists of a carbon fiber rectangular tube 605. According to one preferred embodiment of the present invention, the dimensions of the carbon fiber rectangular tube 605 may be approximately 96.520 cm×2.54 cm×5.0800 cm (38 inches×1 inch×2 inches) with a material thickness of approximately 0.50800 cm (0.2 inch). According to an alternative preferred embodiment, the dimensions of the rectangular tube 605 may be approximately 28 inches×1 inch×2 inches. As shown, the proximal end 615 of the arm unit 600 may preferably include a connection point 625 for a carbon fiber ribbon 450 (shown in FIG. 4). Further, the proximal end may further include an aluminum or steel plug 635 through its pivot point for connection to the lifting mechanism 150 (shown in FIG. 1). Plug 635 may also act as a fastener for the carbon fiber ribbon 450. At the distal end 645 of the arm 600, a second aluminum or steel plug 655 may be further provided as an attachment point for a harness.

According to a preferred embodiment of the present invention, the materials used for the present invention may include unidirectional carbon fiber for all tubes, martinsitic stainless (or hard coated) steel for all pins, shafts and arm pivot bracket, and 7075 or stronger tempered aluminum for the base. Alternatively, any materials with suitable strength characteristics may be used.

While the above descriptions regarding the present invention contains much specificity, these should not be construed as limitations on the scope, but rather as examples. For example, several preferred dimensions and proportions for various aspects of the present invention are provided. However, it should be understood that each of the dimensions and proportions provided may be adjusted and/or changed based on the specific needs of a user. Further, the preferred embodiment of the present invention is shown having four legs. However, according to alternative preferred embodiments, the lift of the present invention may include alternative designs using any combination of three or more legs as needed. Still further, the present invention is discussed and disclosed with respect to the lifting of patients. However, it should be understood that the present invention may be used to lift or support any of a variety of items or individuals in a variety of settings without limitation. Further, the present invention may be modified and/or used in combination with any of a variety of attachments so that it may be customized for specific uses, such as for the lifting of a person into a tub or vehicle or over stairs.

What is claimed is:

1. An apparatus for lifting, wherein the apparatus comprises:

a base housing, wherein the base housing is comprised of a central opening and a plurality of exterior mounts;

a center post, wherein the center post is secured within the central opening of the base housing;

further wherein the base housing is comprised of at least two bearings to constrain the motion of the center post to rotational motion;

a plurality of supporting legs, wherein the supporting legs are connected to the base housing by attachment to the plurality of exterior mounts;

a lifting arm, wherein the lifting arm is movably attached to the center post; and a lifting mechanism, wherein the lifting mechanism is configured to apply a lifting force to the lifting arm;

wherein the lifting mechanism further comprises a locking mechanism; wherein the locking mechanism is configured to keep the lifting arm stationary when in a locked position; further wherein the locking mechanism is configured to allow the stationary arm to rotate when in an unlocked position;

further wherein the gear arrangement comprises a reducing worm gear set which rotates a shaft and spools a carbon fiber ribbon;

wherein the carbon fiber ribbon is configured to wrap around an arm pivot and cause the lifting arm to raise.

2. The apparatus of claim 1, wherein the supporting legs are comprised of carbon fiber rectangular tubes that are pinned to the base housing.

3. The apparatus of claim 2, wherein the supporting legs further comprise non-slip feet attached to each supporting leg.

4. The apparatus of claim 3, wherein the lifting mechanism is comprised of a gear arrangement.

5. The apparatus of claim 4, wherein the lifting arm is comprised of a carbon fiber rectangular tube; wherein the rectangular tube further comprises an attachment point for connecting to a connection mechanism.

6. The apparatus of claim 4, wherein the lifting mechanism further comprises a removable hand crank for applying torque to the reducing worm gear set.

7. The apparatus of claim 2, wherein the lifting mechanism is comprised of a motor.

8. The apparatus of claim 2, wherein the lifting mechanism comprises an electrical drive.

9. The apparatus of claim 2, wherein the lifting mechanism comprises a hydraulic pump.

* * * * *